United States Patent [19]

O'Sheeran

[11] 3,943,672

[45] Mar. 16, 1976

[54] PREFABRICATED, MODULAR STRUCTURE FORMED BY LATERALLY SPACED CANTILEVER ARCH FRAME ASSEMBLIES

[76] Inventor: John H. O'Sheeran, Box 178 c/o Milwaukee Shell Corporation, Plum City, Wis. 54761

[22] Filed: Jan. 3, 1975

[21] Appl. No.: 538,256

[52] U.S. Cl. ..... 52/73; 52/90; 52/86

[51] Int. Cl.[2] ..... E04B 1/32

[58] Field of Search ..... 52/73, 588, 90, 594, 72, 52/86; 46/28

[56] References Cited

UNITED STATES PATENTS

| | | | |
|---|---|---|---|
| 341,735 | 5/1886 | Densmore | 52/92 |
| 2,247,186 | 1/1941 | Chelazzi | 52/73 |
| 2,692,566 | 10/1954 | Mitchell | 52/73 |
| 3,289,362 | 12/1966 | Whelan | 52/92 |
| 3,464,167 | 9/1969 | Mason | 52/90 |
| 3,464,168 | 9/1969 | Russell | 52/86 |
| 3,632,149 | 1/1972 | Konig | 52/758 D |

FOREIGN PATENTS OR APPLICATIONS

| | | | |
|---|---|---|---|
| 417,297 | 8/1910 | France | 52/86 |
| 877,249 | 12/1942 | France | 52/86 |
| 967,200 | 10/1950 | France | 52/90 |
| 101,818 | 11/1916 | United Kingdom | 52/86 |

*Primary Examiner*—Ernest R. Purser
*Assistant Examiner*—Henry Raduazo
*Attorney, Agent, or Firm*—Sughrue, Rothwell, Mion, Zinn & Macpeak

[57] ABSTRACT

A plurality of laterally spaced, generally parallel, cantilever arch frame assemblies formed by interlock T-shaped vertical column members have inwardly and outwardly directed integral, projecting arms at their upper ends. A horizontal beam member is cantilever mounted to one of the arms and a semi-arch member fixed at its base to the ground outwardly of the column has its upper end mounted to the other arm. Roof panels are fixed at opposed edges to respective horizontal beam members by slidably coupling the roof panel to the beam member by interengaging male and female connectors which are respectively integral therewith. Sidewall panels slidably engage integral connectors on the sides of the vertical column member in similar fashion. Corner beams pinned at their ends to the vertical columns are interconnected through female and male connectors with confronting edges of the roof panel and sidewall panel. A center ridge beam connects the outboard ends of the horizontal beam members of respective, longitudinally aligned and oppositely directed cantilever arch frame assemblies as well as the confronting ends of roof panels.

18 Claims, 13 Drawing Figures

PREFABRICATED, MODULAR STRUCTURE FORMED BY LATERALLY SPACED CANTILEVER ARCH FRAME ASSEMBLIES

BACKGROUND OF THE INVENTION

1. Field Of The Invention

This invention relates to building structures in general, and more particularly, to a building structure of rectangular configuration in which structural panels in modular form are interconnected to form the sidewalls, end walls and roof of the building structure.

2. Description Of The Prior Art

Building structures formed of prefabricated panels, manufactured remote from the site of erection of the building are now common to the building industry. However, the assembly of prefabricated panels or other modular units such as sidewalls, roof trusses, columns and the like on the site, is achieved at least partially by conventional building techniques and the assembly of such modular units is difficult in terms of those portions of the building which are completed by conventional building techniques.

SUMMARY OF THE INVENTION

The present invention embodies the formation of a completed, site erected, modular building structure through the use of prefabricated components in the form of frame assemblies, sidewall and end wall panels and roof panels, joined in a mechanically interlocking manner. In this respect, a plurality of cantilever arch frame assemblies are formed by interlocking separate members and are positioned in laterally spaced, generally parallel, fashion. Each assembly includes a T-shaped vertical column member fixed at its base and forming inwardly and outwardly integral arms at the top of the column. A horizontal beam member is cantilever mounted to one of the arms and a semi-arch member is fixed at its base to the ground outwardly of the column and locked at its upper end to the other arm. All connections are effected by interlocking interengagement of male and female connectors formed on respective members. A roof panel is interconnected at opposed edges to the horizontal beam members of adjacent cantilever arch frame assemblies through interengagement of male and female connectors formed on respective members. A sidewall extends between the vertical column members and interlocks thereto by similar interengagement between male and female connectors formed respectively, on the ends of the sidewall panels and the sidewalls of the column members.

The building may be completed by having the side opposite the semi-arch member open, a sidewall panel may be mounted thereto to close off the same, or alternatively, a double size building may be effected by erecting duplicate cantilever arch frame assemblies oppositely oriented and in longitudinal alignment at the same laterally spaced positions, and couple the outboard ends of the horizontal beam members together by the employment of a center ridge beam. Coupling is achieved by interlocking, interengaging male and female connectors formed respectively on the ends of the horizontal beam members and the sides of the center ridge beam at appropriate spaced positions.

Each of the structural components of the building are formed preferably of an outer layer of rigid plastic; resin impregnated, fiberglass material, and preferably a core of polyurethane foam to provide a component which is of high structural rigidity, weatherproofness and waterproofness to withstand atmospheric conditions, but which is relatively light in weight and wherein the polyurethane foam core or ite equivalent acts as a thermal insulator. The components thus require minimum site preparation, may be manufactured remote from the site and may be readily transported thereto for assembly by non-skilled labor.

An important objective of the present invention resides in the utilization of mated male and female connector portions of respective components, and particularly designed for compatibility with the materials employed in creating the structural components. In this regard, the arrangement of the mated male and female connectors is essentially the same as that set forth in copending application Ser. No. 538,245 entitled "Prefabricated, Modular Building Structure," and filed on Jan. 3, 1975.

The manner of assembly permits ready dis-assembly when necessary, and the components may incorporate integrated accessory features such as wiring and plumbing at their point of manufacture to permit on-site electrical and mechanical connections between the accessory units of adjacent components, panels, beams and the like.

Other and further objects and advantages of the invention will become apparent to those skilled in the art from a consideration of the following specification where read in conjunction with the annexed drawings, in which like elements carry like numerical designations.

BRIEF DESCRIPTION OF THE DRAWINGS

FIG. 3A is an exploded, perspective view of a portion of the assembly of FIG. 3 showing an alternate coupling arrangement between the components thereof.

FIG. 7A is a perspective, sectional view, of a portion of an alternate form of floor beam employable in the building structure of FIG. 1.

DESCRIPTION OF THE PREFERRED EMBODIMENT

Figure 1:
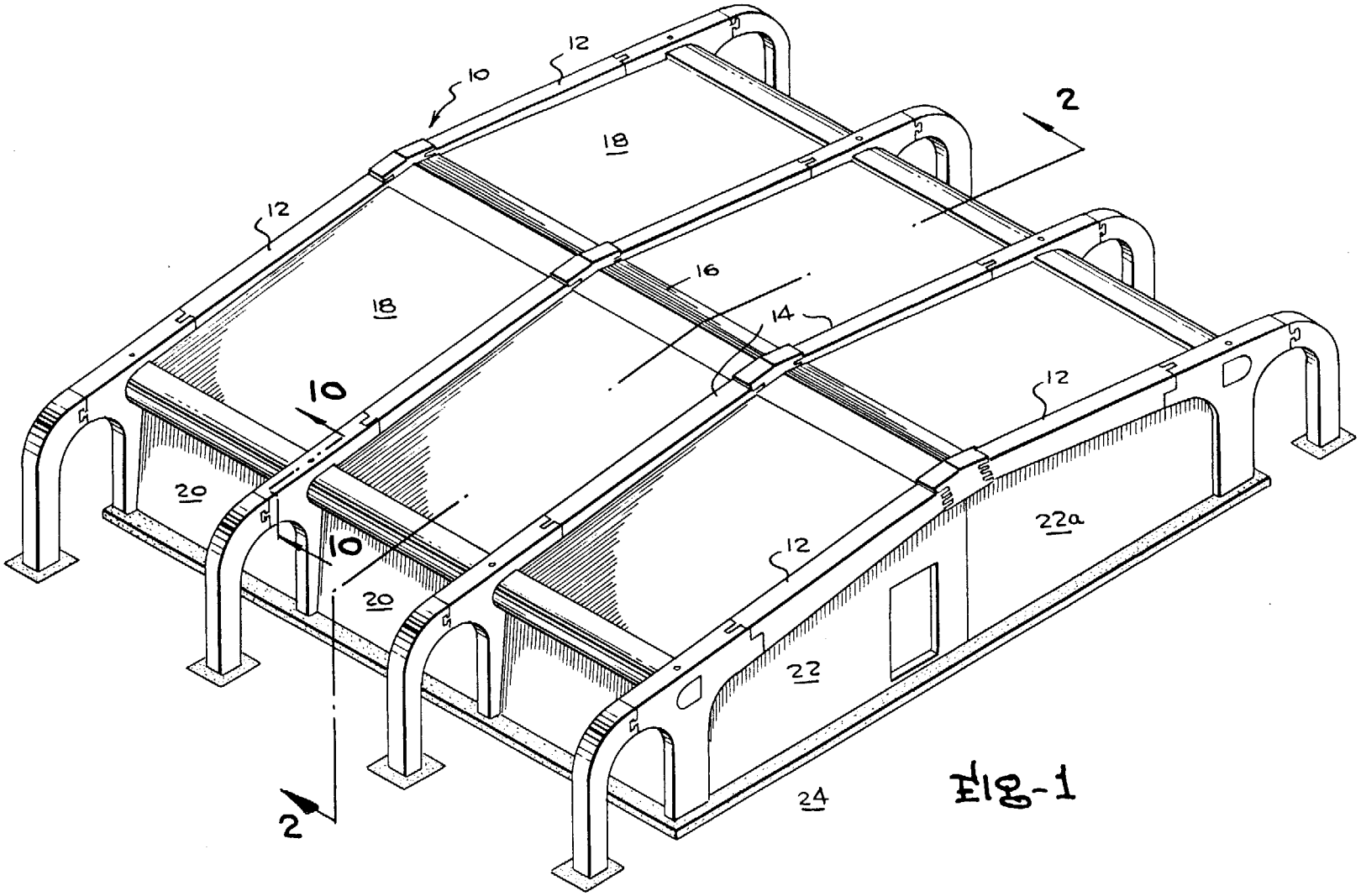
FIG. 1 is a perspective view of a building structure of generally rectangular form, comprising one embodiment of the present invention.
Figure 11:
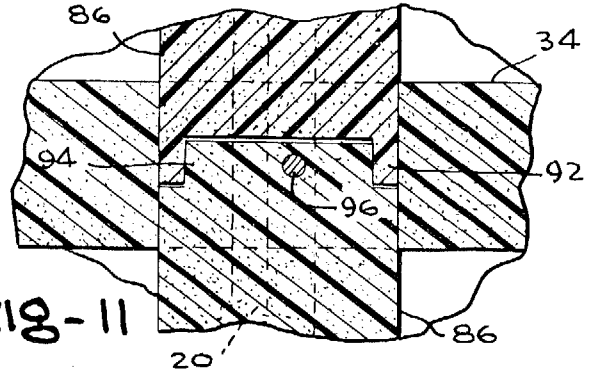
FIG. 11 is a sectional view of the interconnection illustrated in FIG. 10 taken about lines 11—11.
Figure 10:
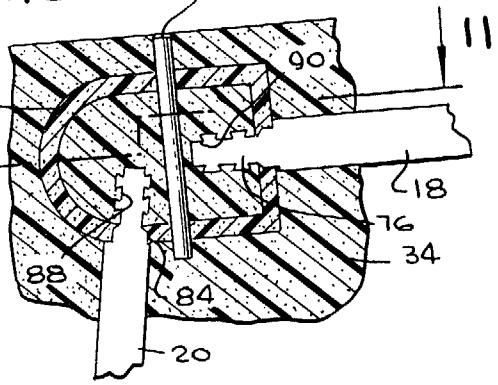
FIG. 10 is a sectional view of the interconnection arrangement of the roof panel, sidewall panel, corner beam and vertical column of the building of FIG. 1 taken about lines 10--10.

Referring to the drawings, FIG. 1 illustrates as an example, one embodiment of the present invention in which the building structure identified generally at 10 comprises a commercial building such as warehouse or the like, of generally rectangular form, which comprises essentially end or partition cantilever arch assemblies 12, intermediate cantilever arch assemblies 14 in the form of oppositely directed and longitudinally aligned pairs. The pairs are joined by a center ridge beam 16 and define the framework for the building. The framework supports a plurality of roof panels 18, sidewall panels 20 and end wall panels as at 22 and 22*a*. Each described component of the building structure and in the case of assemblies 12 and 14, the subcomponents thereof, are preferably formed with an outer layer of rigid plastic; resin impregnated, fiberglass material, and preferably each has a core of polyurethan foam or the like to provide structural components which are of high structural rigidity, high weather and waterproofness and to withstand atmospheric conditions, but are relatively light in weight with the polyurethane foam core or its equivalent acting as a thermal insulator.

Figure 2:
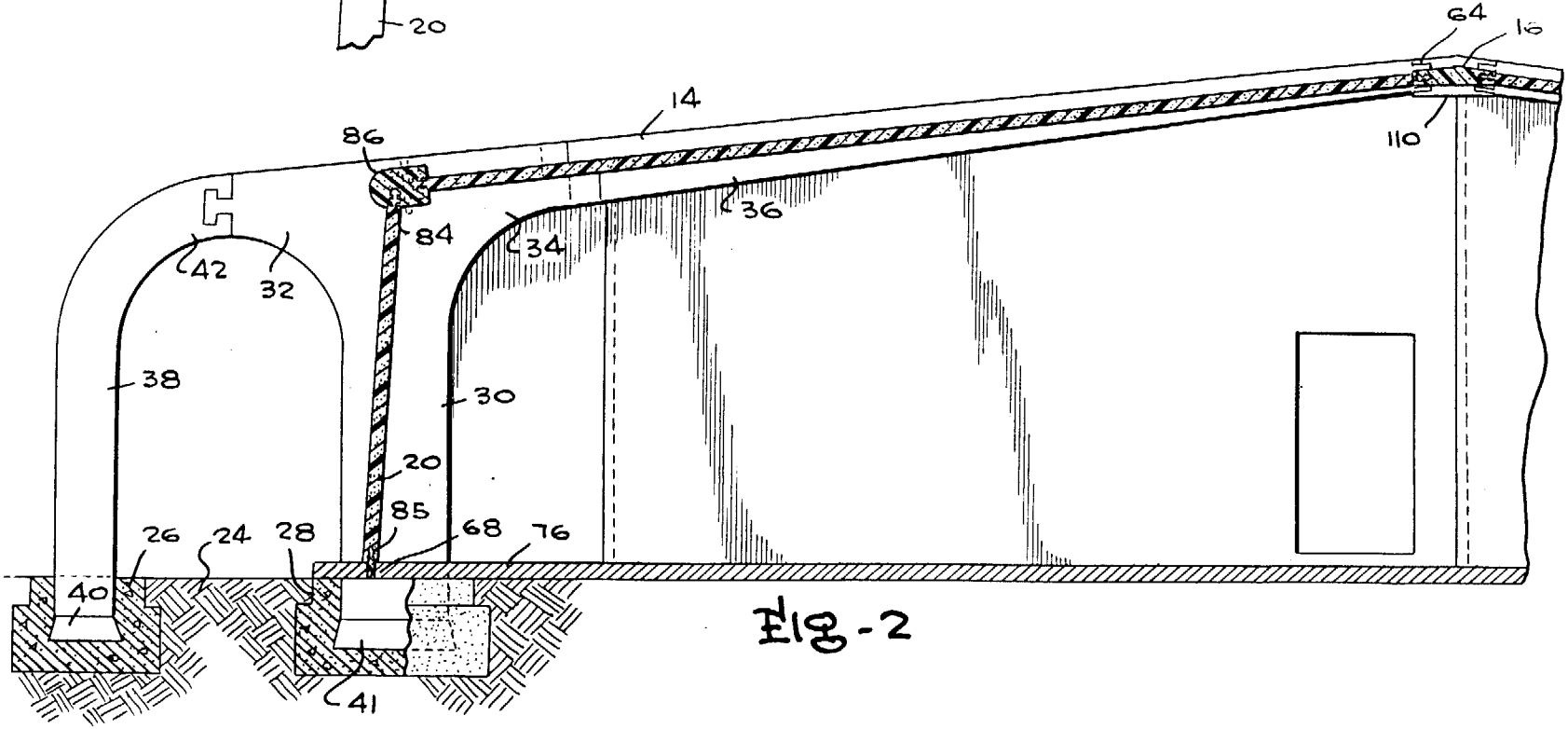
FIG. 2 is a sectional elevational view of a portion of the building structure of FIG. 1 taken about line 2—2.
Figures 3, 4:
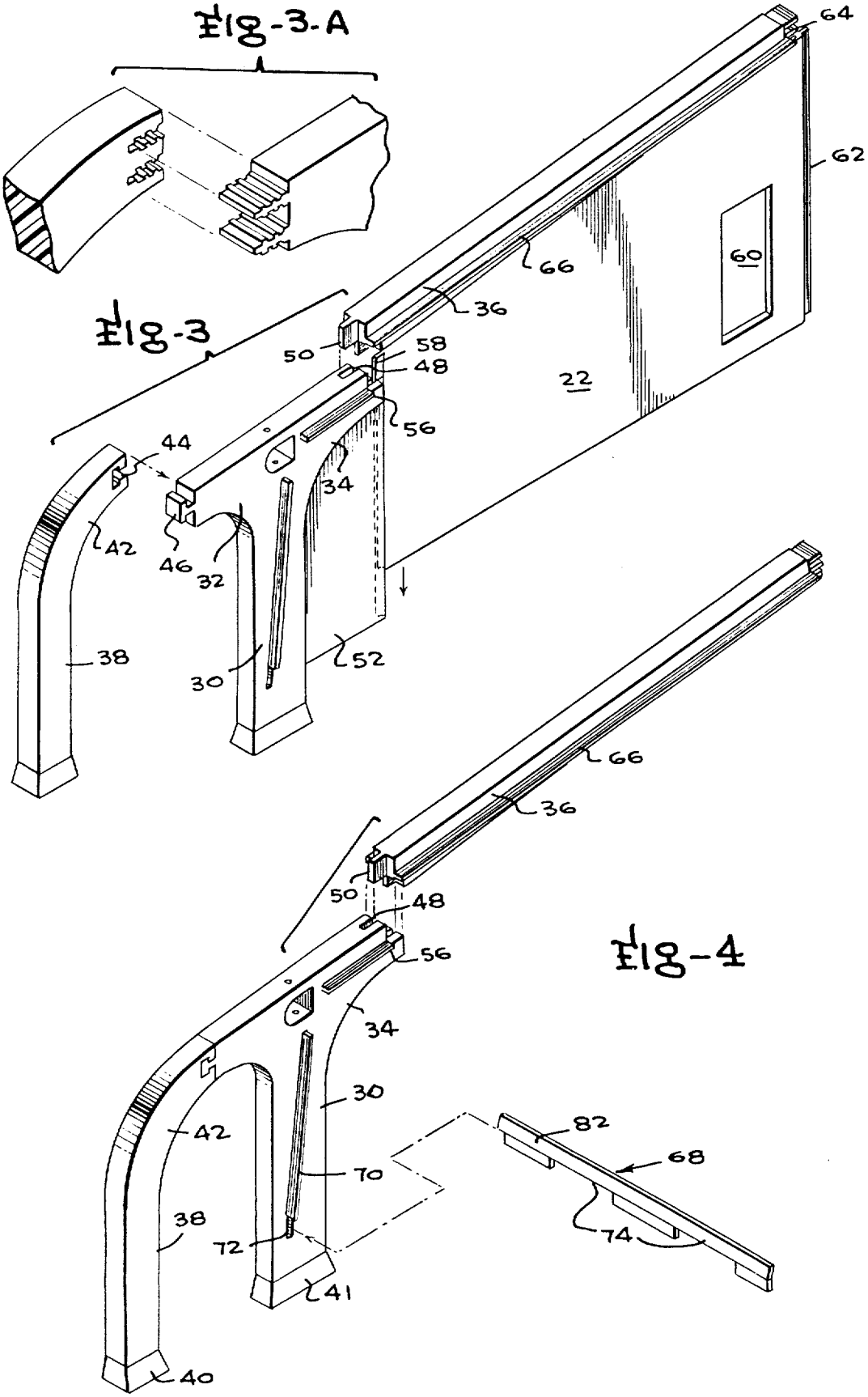
FIG. 3 is an exploded, perspective view of an end or partition arch assembly forming a principal component of the building structure of FIG. 1.
FIG. 4 is an exploded, perspective view of an intermediate cantilever arch assembly of the building structure of FIG. 1, illustrating the mechanical interlocking of the components forming the same.

The building structure 10 whose modular components may be manufactured remote from the site of erection is erected on a site comprising a level area of ground as at 24, and the components are supported by means of poured concrete footings as at 26 and 28, for each cantilever arch assembly 12 and 14. In this respect, reference to FIGS. 2 and 3 illustrates a typical end or partition cantilever arch assembly 12 as comprising essentially three parts, a vertical column or member 30 including a left arm 32 and a right arm 34, a horizontal beam or member 36, mechanically interlocked to the right arm 34 of the vertical column, and a semi-arch member 38. Semi-arch member 38 has its base 40 supported by concrete footing 26 and has its upper end 42 mechanically coupled and interlocked to the left arm 30 of the T-shaped column 30.

It may be appreciated therefore that through the employment of three part cantilever arch framing, and the intricate relationship between the parts forming the functional-structural cantilever-arch allows the framing to be adapted to a cantilever situation in which the building is essentially one-half of that shown in FIG. 1, and the right hand frame assemblies are absent from the structure, or as shown, facilitates the completion of a building structure characterized by a simple beam situation. The end partition cantilever arch assemblies 12 are essentially identical to the intermediate cantilever arch assemblies 14 with the exception that these assemblies support end walls 22 and 22*a*. Where the intermediate cantilever arch assemblies 12, 14 are to be substituted therefor, by partition arch assemblies such as 12 to effect partitioning intermediate of the ends of the building, the uniform dimensions and characteristics of assemblies 14 and 12 permit ready substitution, one for the other.

The mechanical interlocking connection between the components making up assemblies 12 and 14 may be seen by reference to FIGS. 3, 3A and 4. In FIG. 3, interconnection is achieved between the end 42 of the semi-arch member 38, and the vertical column 30 by the employement of a T-shaped female connector slot 44 which receives a similarly configured and dimensioned T-shaped male connector projection 46 and locking occurs by laterally shifting member 38 with respect to member 40, for instance.

A somewhat more complicated mechanical interlock occurs between the column member 30 and the horizontal beam member 36. In this case, the horizontal beam member 36 has at its inboard end, a stepped male configured connector projection 50 which couples with the stepped female connector slot 48 to form a structural connection of high structural integrity and which resists movement. In this respect, it is noted that the horizontal beam member 36, by being positioned above the arm 34 of the T-shaped column 30, permits the male connector projection 50 to be dropped into the female connector slot 48 during interengagement and the contact surfaces of the slot and projection are formed with interlocking means to maintain the cantilever support of the horizontal beam member 36 relative to the vertical column 30. In FIG. 30, it is noted that end wall 22 is of two part construction, that is, it consists of a short length section 52 joined to a longer length section 54, the sections essentially being similar in length to arm 34 and horizontal beam member 36, respectively, from which they depend. The end of end wall section 52 is provided with a vertical slot 56 defining a female connector which cooperates with edge projection strip 58 to securely locate and interconnect sections 52 and 54 of the sidewall 22 when the beam member 36 is mounted to the vertical column 33. The upper end of end wall section 54 may be similarly provided. The end wall section 54 is provided with a door opening 60 and terminates in a male connection projection strip 62, along another edge, while the horizontal beam member 36 which supports the same, terminates at is outboard end in double male connector projections 64. Along one side thereof, an elongated projection strip 66 defines the male connector for a given roof panel 18.

Reference to FIG. 4 shows the same relationship with resepct to an intermediate cantilever arch assembly 14, and in addition, this figure depicts the manner in which a floor beam indicated generally at 68 is coupled, at one end, to the column member 30 during erection of the building structure frame. In this respect, the column member 30 is provided with a slightly inclined but generally vertical male connector projecting strip 70 which extends most of the height of the column and terminates short of a vertical slot 72 at the base 41 of the column member, which slot 72 receives the end of the floor beam 68. Openings 74 are provided at longitudinally spaced positions on the floor beam 68, along its bottom edge to permit the flow of concrete subsequent to erection to form a concrete floor 76, FIG. 1. The base 40 of the semi-arch member 38 and base 41 of column member 30 are encased in and supported by concrete footings 26 and 28 respectively. The unattached end of the floor beam 68, FIG. 4, remains in proper position until the next column member 30 is moved into position, and that end is inserted within the female cavity defined by slot 72 of the next laterally spaced column. Further assemblage of the frame can begin when second semi-arch member 38 is secured thereto.

Figure 5:
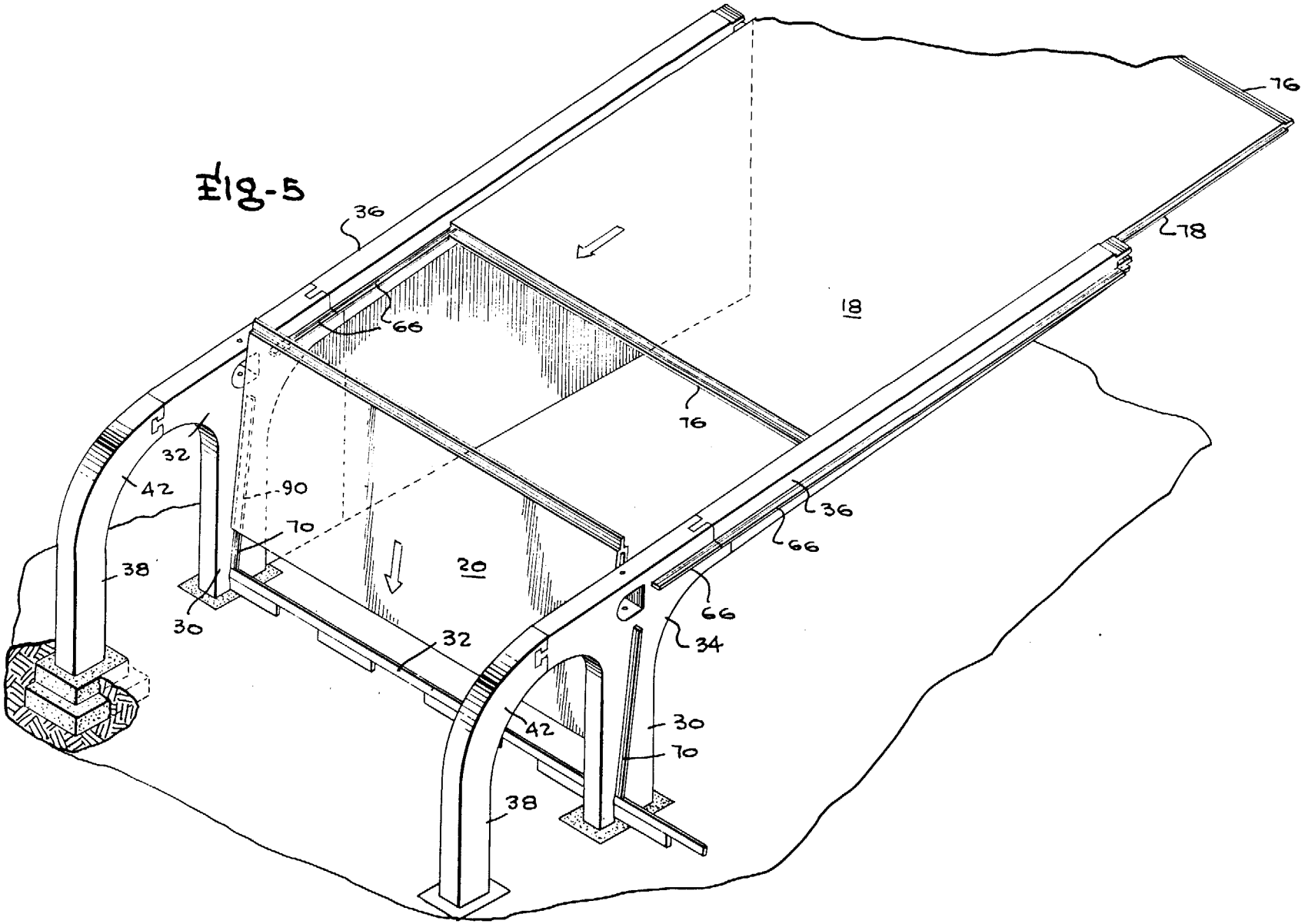
FIG. 5 is a perspective view of a portion of the building of FIG. 1, partially completed, showing in detail, the manner of assembly of the sidewall panels and the roof panels.

Reference to FIG. 5 illustrates the next phase of the assembly, commencing with movement of a roof panel 18 which has bonded at its opposite edges, or otherwise formed, male connector strips 76 and female connector slots 78, respectively. In sliding the roof 18 along the horizontal beam members 36, the female connector slots 78 receive male connector projecting strips 66, locking the roof panel 18 to the frame assembly. At the same time, the sidewall panel 20 is dropped into place between spaced vertical columns 30. Along the side edges of the sidewall panel 20 there are provided female connector slots 80 which receive male connector projection strips 70. At the same time, the inclined, male connector projection strip 82 of the floor beam is received within a female connector slot 85 at the bottom edge of the sidewall panel 20. The sidewall panel is provided along its upper edge with a male connector projection strip 84 which terminates adjacent to but spaced from the male connector projection strip 76 of roof panel 18.

Figure 6:
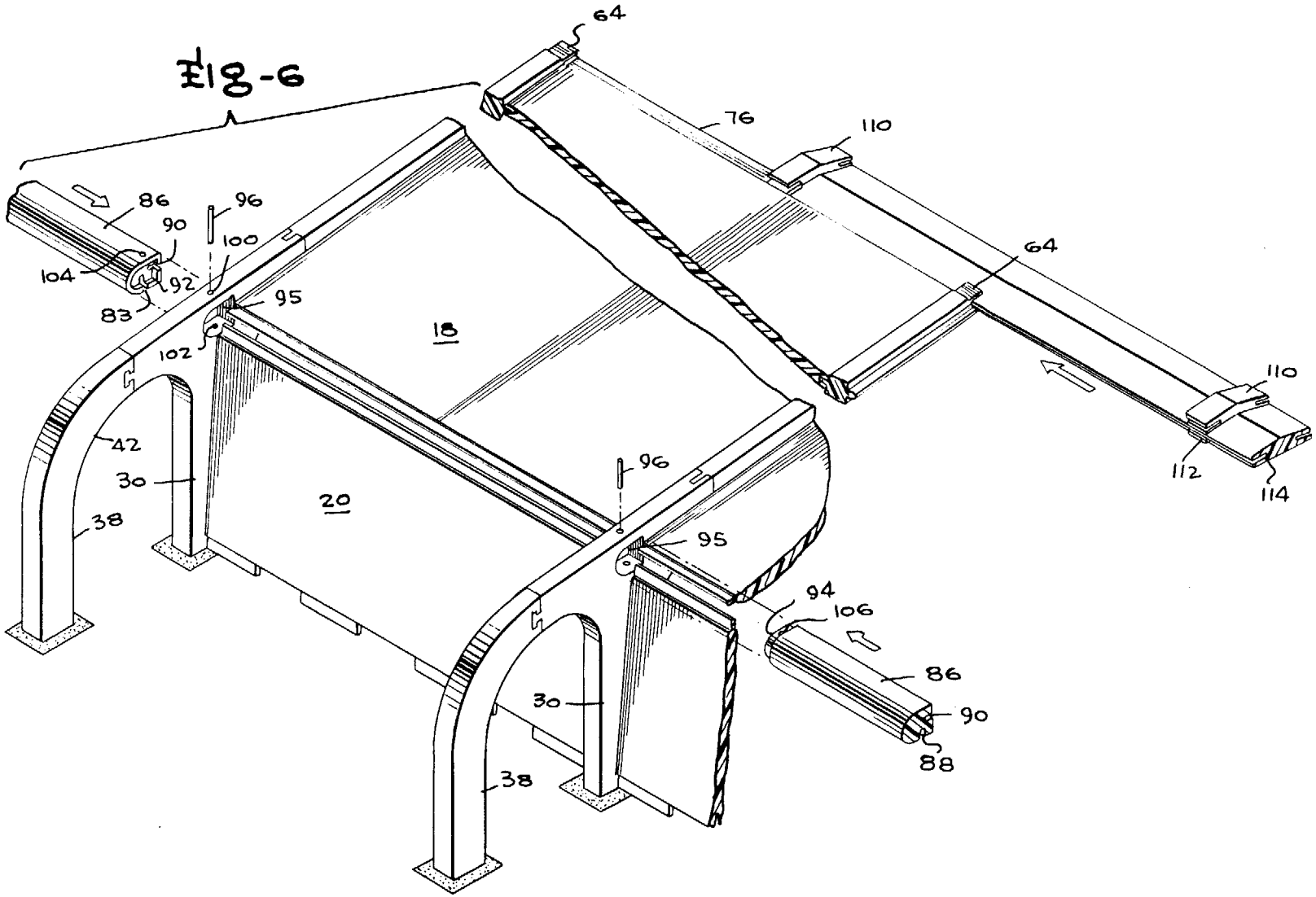
FIG. 6 is a perspective view of a portion of the building structure of FIG. 5, during further assembly, illustrating in detail, the structural make-up and assembly of the corner beam and center ridge beam as components thereof.

The lateral interlocking of adjacent cantilever-arch frame assemblies is accomplished by the use of corner beams 86 which are provided with rounded outer edges but otherwise generally rectangular in form. Corner beams 86 have female connector slots 88 and 90 extending inwardly from the bottom and inside sidewalls thereof, connector slots 88 receiving the male connector projection strip 84 of sidewall panel 20, while female connector slot 90 receives the male connector projection strip 76 of roof panel 18. Thus, the female slots are arranged to concurrently engage the typical male projecting extrusions of the roof and wall panels, thereby interlocking the roof, wall and cantilever arch assemblies. Reference to FIG. 6 illustrates the fact that one end of each corner beam is recessed providing a cavity 92 which receives the male connector appendage or projection 94 of the next in line, end abutting, corner beam 86. The corner beams 86 are passed through holes 95 within column members 30 and it is also at this point, that the male and female connectors at respective ends of the corner beams mate. The holes 95 are of modified rectangular cross section conforming in size and configuration to that of the corner beam cross section. Each hole 95 has the configuration of the beam which is formed of the same material as the arch, so that suitable structural strength and integrity will be retained by the critical knee area of the cantilever arch. The ends of the corner beams are fastened together by a reinforced plastic pin 96 at each arch assembly location. Aligned hole 100 and 102 extend within the column 30 passing through openings 94, while the ends of the corner beams are provided holes 104 and 106 respectively within the female cavity 92 and the male appendage 98 of the corner beams such that when the locking pin 96 is inserted through opening 100 at the top of the column 30, through hole 104 within the female cavity end of the corner beam, and through the male appendage hole 106 of the next abutting and adjacent corner beam, and then through hole 102 at the bottom of opening 95 within column 30, the corner beam and the arch assembly are pin fastened together.

As the desired number of bays are completed for the intended building structure, a monolithic concrete floor 76 may be poured around each cantilever arch assembly base 40 and 41, around and beneath the floor beam 68 particularly through openings 74, the concrete rising to the extent where it embeds the lower edge of the side and end walls as well as the base 41 of the column to effectively form a weatherproof and waterproof seal for the building structure.

Figure 7:
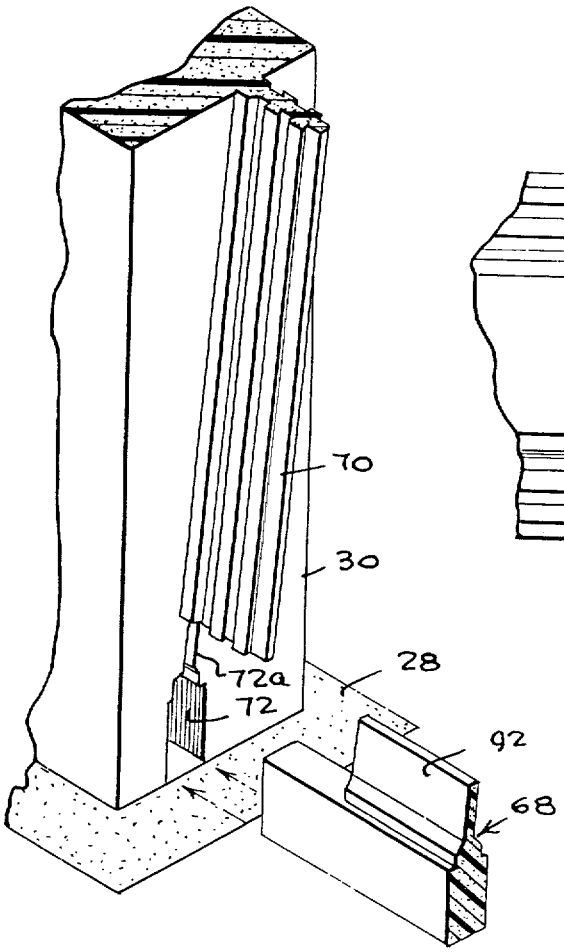
FIG. 7 is an enlarged, perspective view, partially cut-away, of a column member and floor beam forming a portion of the building structure of FIG. 1 and the manner of interlocked, interconnection therebetween.

The details with respect to the manner in which the floor beams interengage the vertical columns 30 may be better appreciated by reference to FIG. 7 and FIG. 7A. In this respect, the column 30 just above the footing 28 carries slot 72 which is rectantgular in cross section at its bottom end, but narrows irregularly at 72*a* conforming to the cross section of the inclined male connector projection strip 82 integral with floor beam 68 such that portion 82 is received within slot portion 72*a* during movement of the floor beam 68 into slot 72 as seen by the arrows. The male connector projection strip 70 which protrudes from the column 30 and is inclined slightly from the vertical in similar manner to male connector projecting strip 82, terminates short of slot 72 so that the strip 82 acts as an extension thereof. In an alternate form, the floor beam 68 of FIG. 7 is provided with an integral, right angle, horizontal portion 69 which terminates in a female connector slot 71 facing inwardly and receiving the male connector projecting strip of a floor panel (not shown) forming an alternate embodiment floor arrangement and eliminating the need for a cast concrete floor. The male connector projecting strip 82 extends upwardly, in this case, therefrom at a slight incline to the vertical in identical fashion to strip 82 of the embodiment of FIG. 7. Thus, a typical floor panel may be built up to create a floor system of the type described in the above identified copending patent application.

The implementation of a "rigid frame" for supporting the roof panels and sidewall panels is made possible through the use of center ridge beam 16 and its manner of interlocking connection with respect to the outboard ends of the horizontal beam members 36 which may be seen by further reference to FIG. 6. The built up female connectors 110 comprising paired slots 112 receive the male connector projections 64 and in this manner, opposed sets of mechancially interlocked cantilever arch assemblies which are oppositely oriented but in alignment form a simple beam situation as noted previously. The edges of the roof panels 18 facing the center ridge beam are provided with male connector projection strips 76, which are received within female connector slots 114 of respective side edges of the center ridge beam 16.

Figure 9:
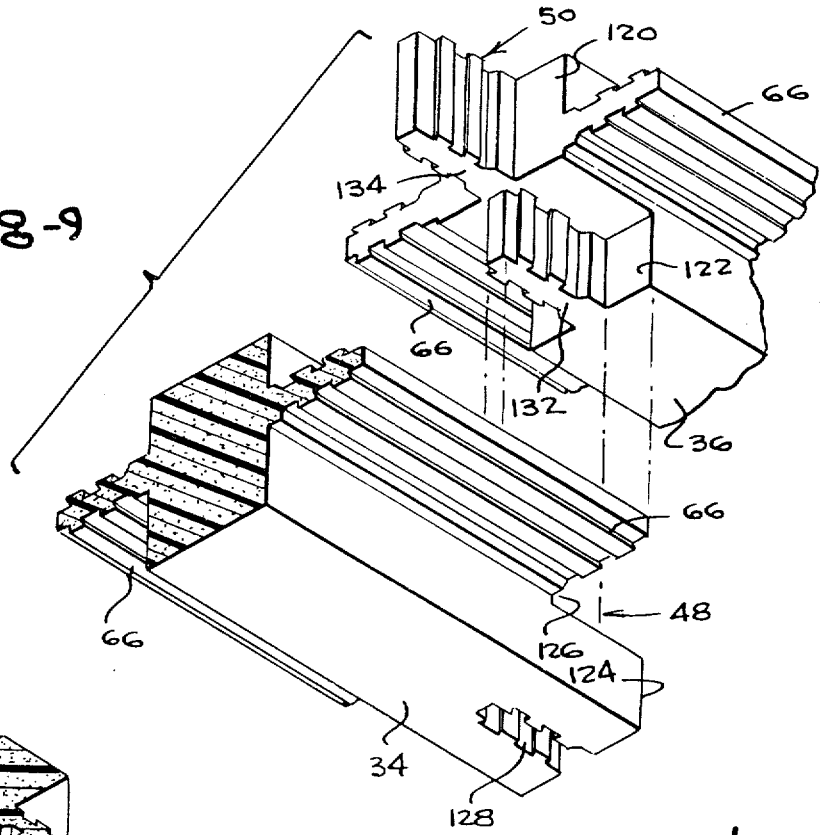
FIG. 9 is an exploded, perspective view of the interconnection arrangement of FIG. 8.
Figure 8:
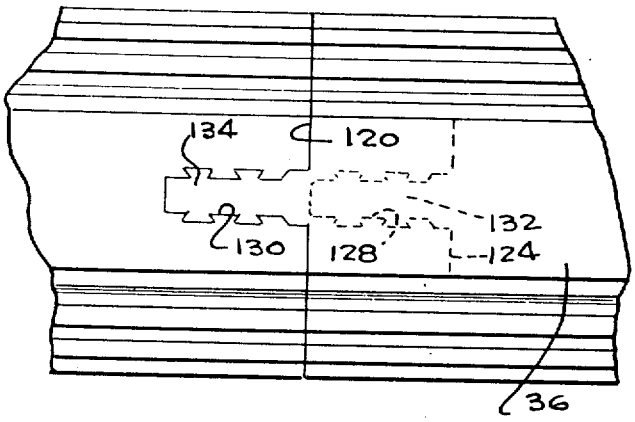
FIG. 8 is a plan view of the interconnection between the horizontal beam vertical column of the building structure for one of the cantilever arch frame assemblies of the building structure of FIG. 1.
Figure 8:
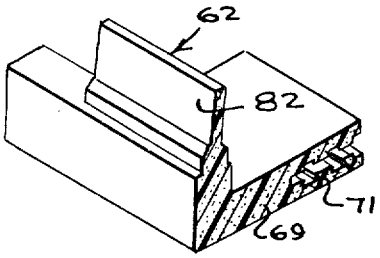

Reference to FIGS. 8 and 9 disclose in detail the manner in which the horizontal beam member 36 may be cantilever interlocked at the end of the arms 34 of the vertical column member 30 and wherein by way of this mechanical interlock connection, the absence of the employment of an oppositely directed frame system joined thereby by means of a center ridge beam. It is noted that arm 34 of the column member 30 in FIG. 3 terminates at its outboard end in a stepped female connector identified generally at 48, while the horizontal beam member 36 terminates at its inboard end in a male connector projection identified generally at 50. Specifically, by additional reference to enlarged FIGS. 8 and 9, the horizontal beam member 36 is stepped such that its upper end face 120 extends beyond the lower end face 122 while the lower end face 124 of arm 34 projects beyond the upper end face 126 of that arm. Thus, slots forming the female connector portion for arm 34 are also stepped as seen at 128 and 130 in FIG. 8, while the male connector projections 132 and 134 are stepped to conform to the offsetting of slots 128 and 130. The method of interfitting and the abutment between the end faces may be readily seen in FIG. 8. In order to prevent the horizontal beam 36 from toppling over disrupting its cantilever support, in the illustrated embodiment of the invention, it is noted that the surfaces defining slots 128 and 130 and projections 132 and 134 are provided with interengaging keys and keyways which not only maintain closely controlled axial alignment between the horizontal beam member and the arm 34 receiving the same, but prevent by the inclined plane contact between engaging surfaces, any tendency on the part of the cantilever support horizontal beam member 36 from sagging relative to the T-shaped column member 30 which supports the same. It is noted that the surface configuration to the projecting male connector and the female connector slot is essentially the same as that appearing within the referred to, copending application, and reference may be had thereto for a better description of the structural relationship between these elements and the functional aspects of the same. Further, it is noted that while this relationship is discussed somewhat in detail with respect to the portion of the frame assembly illustrated by FIGS. 8 and 9, it applies equally to all of the male and female interlocking connections made between the various components making up the building structure of the present invention, and such features are liberally illustrated throughout the many drawings. The opposed keystone shaped slots or grooves and the keystone shaped surface projections or ribs create the mechanical interlocking means between the female connectors and the male connectors to maintain minimum tolerances and to prevent the creation of air gaps between members making up the building structure providing an air tight structure of high structural integrity and which effectively prevents separation therebetween.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A prefabricated, modular building structure comprising: a plurality of laterally spaced, generally parallel cantilever arch frame assemblies, each frame assembly comprising a T-shaped vertical column member having integral inwardly and outwardly projecting arms and a base mounted to the ground, a horizontal beam member mounted to one of said arms and extending outwardly therefrom in cantilever aligned fashion and a semi-arch member fixed at its base to the ground to one side of said column member in alignment therewith, and having its upper end mounted to the other column arm, said assembly members being mounted to each other by interlocking male and female connectors formed on respective members, and at least a roof panel mounted along opposite side edges to respective horizontal beam members of adjacent frame assemblies.

2. The building structure as claimed in claim 1, wherein said roof panel is mounted to said horizontal beam member by means of interengaging, mechanically interlocking slots and and projecting strips carried respectively by said panel and said horizontal beam members.

3. The building structure as claimed in claim 1, wherein for each frame assembly, the end of said beam member is mounted to said column member arm by stepped end faces defining respectively multiple pairs of male connector projections and female connector slots and wherein the contacting surfaces of said slots and said projections carry in turn interengaging keyway slots and ribs whose longitudinal axes extend at right angles to the longitudinal axes of said arm and said horizontal beam member to prevent sagging of said beam member relative to the cantilever supporting column member when mounted to each other.

4. The building structure as claimed in claim 1, wherein opposite sides of the said column members are provided with inclined male connector projecting strips and said structure further comprises sidewall panels extending between the column members of adjacent frame assemblies with said sidewall panels having female connector slots along the ends thereof and engaging said male connector projection strips to mechanically lock said sidewall panels to said column members.

5. The building structure as claimed in claim 2, wherein opposite sides of the said column members are provided with inclined male connector projecting strips and said structure further comprises sidewall panels extending between the column members of adjacent frame assemblies with said sidewall panels having female connector slots along the ends thereof and engaging said male connector projection strips to mechanically lock said sidewall panels to said column members.

6. The building structure as claimed in claim 3, wherein opposite sides of the said column members are provided with inclined male connector projecting strips and said structure further comprises sidewall panels extending between the column members of adjacent frame assemblies with said sidewall panels having female connector slots along the ends thereof and engaging said male connector projection strips to mechanically lock said sidewall panels to said column members.

7. The building structure as claimed in claim 4, wherein the confronting ends of said roof and sidewall panels are provided with engageable connectors and said structure further comprises corner beams having complementary interlocking connectors on the sides thereof facing respectively, said panel ends and engageable therewith to form a weathertight connection therebetween.

8. The building structure as claimed in claim 5, wherein the confronting ends of said roof and sidewall panels are provided with engageable connectors and said structure further comprises corner beams having complementary interlocking conectors on the sides thereof facing respectively, said panel ends and engageable therewith to form a weathertight connection therebetween.

9. The building structure as claimed in claim 6, wherein the confronting ends of said roof and sidewall panels are provided with engageable connectors and said structure further comprises corner beams having complementary interlocking connectors on the sides thereof facing respectively, said panel ends and engageable therewith to form a weathertight connection therebetween.

10. The building structure as claimed in claim 7, wherein said column members each include openings therein at locations in alignment with said corner beams, and being of similar size and configuration, said corner beams extending between said assemblies and being carried at respective ends by said column members within said column member openings.

11. The building structure as claimed in claim 8, wherein said column members each include openings therein at locations in alignment with said corner beams, and being of similar size and configuration, said corner beams extending between said assemblies and being carried at respective ends by said column members within said column member openings.

12. The building structure as claimed in claim 9, wherein said column members each include openings therein at locations in alignment with said corner beams, and being of similar size and configuration, said corner beams extending between said assemblies and being carried at respective ends by said column members within said column member openings.

13. The building structure as claimed in claim 10, wherein: said corner beams are provided with complementary male and female connectors on the ends thereof, locking pin receiving holes pass vertically through the columns and intersect said openings, said corner beam ends at said complementary male and female connectors are provided with corresponding aligned locking pin receiving holes which pass through respective connectors, and said structure further comprises locking pins positioned within said locking pin receiving holes for locking aligned corner beams together and within said column openings to create an integrated building frame of high structural integrity.

14. The building structure as claimed in claim 11, wherein: said corner beams are provided with complementary male and female connectors on the ends thereof, locking pin receiving holes pass vertically through the columns and intersect said openings, said corner beam ends at said complementary male and female connectors are provided with corresponding aligned locking pin receiving holes which pass through respective connectors, and said structure further comprises locking pins positioned within said locking pin receiving holes for locking aligned corner beams together and within said column openings to create an integrated building frame of high structural integrity.

15. The building structure as claimed in claim 12, wherein: said corner beams are provided with complementary male female connectors on the ends thereof, locking pin receiving holes pass vertically through the columns and intersect said openings, said corner beam ends at said complementary male and female connectors are provided with corresponding aligned locking pin receiving holes which pass through respective connectors, and said structure further comprises locking pins positioned within said locking pin receiving holes for locking aligned corner beams together and within said column openings to create an integrated building frame of high structural integrity.

16. The building structure as claimed in claim 1, wherein multiple pairs of oppositely directed frame assemblies have the ends of said horizontal beam members of respective frame assemblies remote from said column members positioned in adjacent, confronting position, and said building structure further comprises a center ridge beam extending between multiple pairs of frame assemblies and being mechanically interlocked along respective sides thereof, to the ends of the said horizontal beam members to form an integrated building frame of high structural integrity.

17. The building structure as claimed in claim 13, wherein multiple pairs of oppositely directed frame assemblies have the ends of said horizontal beam members of respective frame assemblies remote from said column members positioned in adjacent, confronting position, and said building structure further comprises a center ridge beam extending between multiple pairs of frame assemblies and being mechanically interlocked along respective sides thereof, to the ends of the said horizontal beam members to form an integrated building frame of high structural integrity.

18. The building structure as claimed in claim 15, wherein multiple pairs of oppositely directed frame assemblies have the ends of said horizontal beam members of respective frame assemblies remote from said column members positioned in adjacent, confronting position, and said building structure further comprises a center ridge beam extending between multiple pairs of frame assemblies and being mechanically interlocked along respective sides thereof, to the ends of the said horizontal beam members to form an integrated building frame of high structural integrity.

* * * * *